United States Patent [19]

Heissler

[11] Patent Number: 4,724,289

[45] Date of Patent: Feb. 9, 1988

[54] FLUID PRESSURE SWITCH HAVING A SPRING OPPOSING THE FLUID PRESSURE

[75] Inventor: Günther Heissler, Eberdingen-Hochdorf, Fed. Rep. of Germany

[73] Assignee: Robert Scheuffele GmbH & Co. KG, Bietigheim-Bissingen, Fed. Rep. of Germany

[21] Appl. No.: 5,660

[22] Filed: Jan. 21, 1987

[30] Foreign Application Priority Data

Feb. 1, 1986 [DE] Fed. Rep. of Germany ..... 3603059

[51] Int. Cl.[4] ..... H01H 35/38

[52] U.S. Cl. ..... 200/82 R; 200/83 S; 200/82 C

[58] Field of Search ..... 73/745; 340/626; 200/81 R, 82 R, 82 C, 83 R, 83 J, 83 P, 83 S, 83 SA, 302

[56] References Cited

U.S. PATENT DOCUMENTS

| | | | |
|---|---|---|---|
| 2,418,508 | 4/1947 | Goepfich | 200/82 C |
| 3,043,929 | 7/1962 | Guthrie | 200/82 C |
| 3,619,526 | 11/1971 | Riley . | |
| 3,953,692 | 4/1976 | Amano | 200/83 S |
| 4,532,389 | 7/1985 | Woods | 200/83 S |

FOREIGN PATENT DOCUMENTS

| | | |
|---|---|---|
| 1940338 | 12/1970 | Fed. Rep. of Germany . |
| 3311083 | 9/1984 | Fed. Rep. of Germany . |
| 2076592 | 12/1981 | United Kingdom . |

*Primary Examiner*—G. P. Tolin

*Attorney, Agent, or Firm*—Burns, Doane, Swecker & Mathis

[57] ABSTRACT

A pressure switch assembly includes an electric switch which is actuated in response to a preselected pressure in a pressure line. The assembly includes an activating rod which is engageable with the electric switch. The activating is acted upon by opposing forces from the pressure and a spring. The spring bears against a stop ring which is threadedly mounted so as to be displaceable in order to adjust the spring force. The stop ring is rotated by rotating a cover portion of the switch housing, the cover being connected to the stop ring. Thereafter, the cover is locked against rotation.

7 Claims, 2 Drawing Figures

II
16
24
21
3
14
13
23
14
12
1a
17
20
22
18
4
4A
19
5
6
3a
7
10b
15
1b
10
11
10a
1
9
8
26
25
27
29
28
30
32
31
2
II

FLUID PRESSURE SWITCH HAVING A SPRING OPPOSING THE FLUID PRESSURE

BACKGROUND OF THE INVENTION

The present invention relates to a pressure switch assembly which is actuated in response to a certain pressure in a pressure line.

Pressure switches of this type are known which comprise a switch housing having a sensing or activating element. The sensing element is exposed to pressure from a pressure line, and a spring acts against the sensing element to resist the pressure. The spring bias defines the switching point. The sensing element is arranged to contact a switching element of an electric switch located in the housing. The spring abuts against a stop ring which is adjustable by a threaded screw to vary the switching point. A cover is provided to retain the electric switch in the housing (see German Patent AS-No. 19 40 338).

In the known configurations a cylindrical switch housing is provided, in the upper part of which the electric switch is located, secured by the cover. Axially therebeneath is provided the stop ring which is guided in a cylindrical recess of the switch housing. The spring pushes the stop ring against a mushroomshaped sensing element exposable to pressure. An adjusting screw protrudes laterally into the switch and against the stop ring. The position of the stop ring, and thus the switching force actuating the switching process, may therefore be adjusted by the operation of the adjusting screw. A disadvantage of this configuration is that the pressure switch is too bulky for a number of applications, due mainly to the laterally projecting adjusting screw. A further disadvantage involves the fact that the contact-closing distance, and thus the switching hysteresis, cannot be altered after installation, as the electrical switch itself is seated fixedly in the housing.

Pressure switch configurations are also known (German Patent OS-No. 33 11 083) in which a lever gear is inserted between a membrane-type sensing element exposed to pressure, and the switching element of the electric switch. The transmission ratio of the gear may be varied from the outside. Such a configuration has the advantage that the switching hysteresis of the electric switch is adjustable, but the switch built in this manner is very expensive and may be prone to failure in certain applications due to its complex design.

The afore-mentioned configurations have in common the fact that the switching pressure may be adjusted at any time from the outside, which in the case of certain switches is undesirable, if a certain predetermined switching point has been set.

It is, therefore, an object of the present invention to design a pressure switch of the aforementioned type so that, the switching point may be adjusted in a very simple manner, after the thus-set switching point cannot be altered or can be altered only by means of special tools.

SUMMARY OF A PREFERRED EMBODIMENT OF THE INVENTION

The invention involves a pressure switch of the aforementioned type wherein the cover comprises a disk rotatably set into a cylindrical recess of the switch housing but capable of being immobilized in the direction of rotation. The disk is connected positively with a stop ring by means of axially extending projections. The stop ring is provided with a screw thread on its periphery and is held rotatingly in a threaded section of the switch housing. By virtue of this configuration the novel switch may be easily adjusted in the already assembled state, but with the cover disk not as yet locked against rotation, by rotating the cover disk which is accessible from the outside. Only thereafter is the cover disk secured positively against rotation. The novel configuration therefore provides assurance that the pressure switches may be adjusted to certain switch points independently of tolerances to be observed, in a simple manner prior to their final installation, so that the production of rejects may be avoided.

The disk may be provided on its periphery with a continuous gasket, making possible a dust-proof and potentially even water-tight closure of the switch. The disk may be locked against rotation in a simple manner by equipping the switch housing with a peripheral locking part surrounding the disk, for example in the form of bendable clips or permanently deformable collar parts, securing the disk positively against rotation. In a particularly simple and advantageous manner this peripheral locking part is in the form of peripheral bead, which may be forced against the stop collar of the disk.

The positive connection of the disk with the stop ring may be effected by means of axially projecting catches which engage corresponding recesses in the stop ring. In a particularly simple manner these catches may be in the form of prongs extending parallel to the axis of rotation of the stop ring and engaging corresponding pockets in the stop ring, whereby the cover acts as a tool for rotating the stop ring for the adjustment of the switching force, prior to the locking of the cover disk against rotation.

BRIEF DESCRIPTION OF THE DRAWING

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
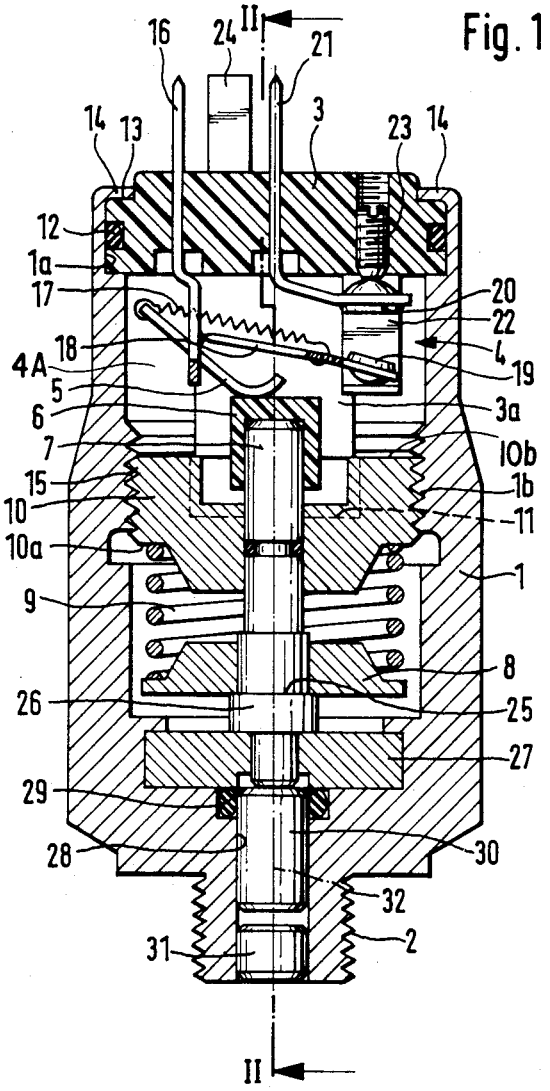
FIG. 1 depicts a schematic longitudinal section through a pressure switch assembly according to the invention.

Within an essentially sleeve-like switch housing 1, an electric switch 4 of a known configuration is located. A switching element 5 of the switch comprises a strap supported pivotingly on the lower part of a first contact tab 16. A lower end of the strap abuts against an insulating cap 6 surrounding the upper end of an activating element 7. A tensile spring 17 has one end attached to an upper end of the strap 5 and another end acting against a contact tab 18. The contact tab 18 is articulated pivotingly on the lower part of the contact tab 16 and is pivotable in response to pivoting of the strap 5 between either a contact-open position (as shown) in which the switching contact 19 abuts against the lower end of a shackle 22, or a contact-closed position in which the contact 19 engages a contact 20 of a second contact tab 21.

The stationary contact 20 of the contact tab 21 may be positionally adjusted to vary the closing distance, by means of a threaded pin 23. The pin 23 penetrates from the outside through a threaded hole in a disk 3 to define a microswitch closing-off the top of the switch housing 1. The electric contact tabs 16 and 21 pass through this disk, which is made of an insulating material. The disk 3 is further provided with a guide pin 24 to assure that the tabs 16, 21 will be properly mated to an electrical connector (not shown).

The switch housing 1 is provided in its approximate center with an internal adjusting thread 1*b*. A stop ring 10 with external threading 15 is guided in this adjusting thread. The stop ring includes a center bore receiving the activating element 7 which is in the shape of a piston rod. Also, the stop ring 10 includes, on one side thereof a stop surface 10*a* serving as a stop for the upper end of a helical compression spring 9. The opposite side 10*b* of the stop ring faces the switch 4 and a cover 3 to define therewith a switch-containing region 4A. The lower end of the spring 9 applies pressure to a disk 8 which is arranged concentrically relative to the activating element 7 and which rests on a shoulder 25 of a collar 26 of the rod 7.

In the position shown, the collar 26 is pressured by the spring against a closure disk 27 fixedly mounted on the housing. The disk 27 defines an upper limit of a center bore 28 in the switch housing and secures a gasket 29 in its seat in the housing. The gasket 29 surrounds a switching piston 30 located in an axially displaceable manner in the bore 28. The piston 30 is held in the bore by an insert 31 pressed into the bore 28. The switch housing 1 may be connected by means of a threaded connector 2 with a fluid pressure line, the pressure of which is to be monitored or regulated by the switch assembly.

The upper end of the switching piston 30 abuts a lower end of the rod 7. When pressure in the pressure line increases, the switching piston 30 presses upwardly against the rod 7 with increasing force. When the upward forces exceed the downward force exerted by the spring 9, i.e., when the switching point is reached, the rod 7 will be raised to cause the contact 19 to engage the contact 20. Accordingly, a signal means can be activated, or means for adjusting the pressure can be activated.

The stop ring 10 is provided with two diametrically opposite recesses in the form of rectangular pockets 11, into which project a pair of arms in the form of prongs 3*a* and 3*a*', the prongs 3*a*, 3*a*' protruding axially from the lower end of the disk 3. The prongs 3*a*, 3*a*' which are oriented parallel to each other and to the axis 32 of the pressure switch, positively engage the pockets 11, 11' and make it possible to rotate the stop ring 10 by a rotation of the disk 3, i.e., the prongs transmit rotary forces from the cover to the stop ring. The counter force applied by the spring 9 to the ring 8 and thus to the piston 30 may therefore be adjusted by the rotation of the disk 3. The sensitivity of the switch can thus be set in this manner.

Figure 2:
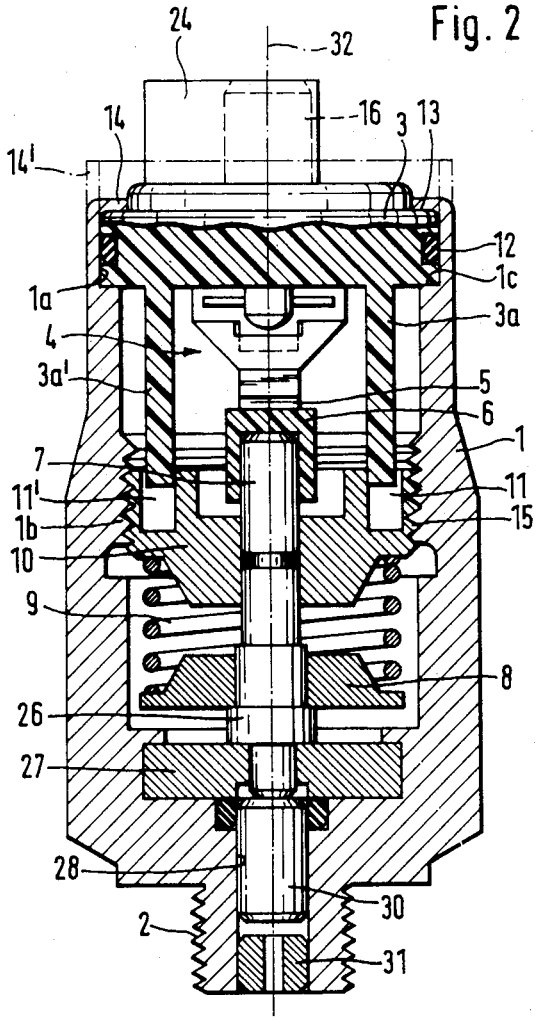
FIG. 2 depicts a longitudinal section through the pressure switch taken along line II—II in FIG. 1.

The principal structural parts of the switch assembly, with the exception of the components of the electric switch 4, are located essentially concentric to the center axis 32 of the switch housing 1. Hence, the switch assembly may be manufactured very simply by the insertion of the parts exposed to pressure, whereby these parts, including the top ring 10, the counter disk 8, and the spring 9 may be inserted together as a structural unit and fastened in the switch housing by screwing the stop ring 10 into the thread 15. Subsequently, the disk 3, which carries the switch 4, is inserted into the cylindrical recess 1*a* on the upper end of the switch housing 1. The disk 3 is sealed off with respect to the switch housing 1 by a gasket 12 arranged on its periphery and held axially toward the inside of the housing on the circumferential rim 1*c* of the switch housing 1. The disk 3 may still be rotated in this temporary position relative to the switch housing 1, which may be effected, for example, by applying force to the guide pin 24. The switch housing 1 comprises at its upper end a circumferential rim 14' indicated in FIG. 2 by a broken line.

In this nearly complete state of assembly, the sensitivity (i.e., switching point) of the switch assembly may be set by connecting the thread 2 of the switch housing 1 with a test line exposed to the switching pressure. The disk 3 is then rotated until the electric switch 4 performs the switching process desired, whereupon it is known that the proper sensitivity has been attained. When this has been accomplished, the beaded rim 14 is bent from its position 14' over a stop shoulder 13 of the disk 3 and forced against the shoulder 13, so that the disk 3 is positively secured aganst movement not only axially but also in the direction of rotation. The switch assembly is then ready for mounting and is set accurately for the switching point desired. The existence of tolerance related deviations in the individual switches is immaterial. Following the setting of the position of the disk 3, all of the pressure switches have the same switching point desired.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What I claim is:

1. A fluid pressure switch assembly of the type which is actuable by fluid pressure to which it is exposed, said fluid pressure switch assembly comprising:

a switch housing containing means for transmitting said fluid pressure, an electric switch disposed in said housing adjacent one end thereof, a cover comprising a disk mounted in said one end of said housing closing said one end of said housing and fixedly positioning said electric switch within said housing a spring disposed within said housing, activating means disposed within said housing and arranged to be displaceable to activate said electric switch, said activating means being operably connected between said fluid pressure transmitting means and said switch and arranged to be acted upon in opposing directions by forces from said spring and fluid pressure, respectively, so that said activating means is displaced in response to a preselected difference between said forces to activate said electric switch, and means for adjusting said spring force, comprising:

a stop ring having one side facing and acting against said spring, and an opposing side facing said switch and said disk such that said stop ring and said disk define a switch-containing region therebetween, said stop ring being threadedly mounted within said housing so as to be displaceable upon being rotated, in order to vary said spring force applied against said activating means, rotation-transmitting means including a plurality of arms carried by one of said disk and a stop ring and extending through said switch-containing region into engagement with recess means in the other of said disk and stop ring to produce rotation of said stop ring in response to rotation of said disk relative to said housing, and locking means for preventing further rotation of said disk following adjustment of the spring force.

2. A pressure switch assembly according to claim 1, including a sealing gasket arranged between said disk and said housing.

3. A pressure switch assembly according to claim 1, wherein said disk has a stop shoulder along its outer edge, said housing including a rim overlying said stop shoulder to retain said disk in said housing, preventing rotation of said disk.

4. A pressure switch assembly according to claim 3, wherein said rim constitutes a bent end of said housing.

5. A pressure switch assembly according to claim 1, wherein said arm extend parallel to an axis of rotation of said stop ring.

6. A pressure switch assembly according to claim 1, wherein said adjusting means comprises a piston rod displaceable through said stop ring along a path coinciding with an axis of rotation of said stop ring, said spring comprising a coil compression spring positioned between said stop ring and a collar fixed to said piston rod to urge said piston rod away from said electric switch.

7. A pressure switch assembly according to claim 6, wherein said arms are carried by said disk.

* * * * *